US005979288A

United States Patent [19]

Gallagher et al.

[11] Patent Number: 5,979,288

[45] Date of Patent: Nov. 9, 1999

[54] HELICAL BRAIDER

[75] Inventors: James L. Gallagher, Little Compton, R.I.; Stephen C. Nolet, Franklin, Mass.

[73] Assignee: Fiberspar Spoolable Products, Inc., West Wareham, Mass.

[21] Appl. No.: 09/080,850

[22] Filed: May 18, 1998

[51] Int. Cl.[6] ..... D04C 3/24

[52] U.S. Cl. ..... 87/36; 87/41; 87/45; 57/10; 57/18

[58] Field of Search ..... 87/33–36, 41, 87/44, 45, 47, 48, 62; 57/3, 6, 10, 11, 12, 18

[56] References Cited

U.S. PATENT DOCUMENTS

| | | | |
|---|---|---|---|
| Re. 35,081 | 11/1995 | Quigley . | |
| 1,141,382 | 6/1915 | Leeuw | 87/34 |
| 1,144,716 | 6/1915 | Lundgren | 87/34 |
| 1,611,619 | 12/1926 | Turck | 87/31 |
| 2,810,424 | 10/1957 | Swartswelter et al. . | |
| 3,007,497 | 11/1961 | Shobert | 138/125 |
| 3,089,379 | 5/1963 | Finor et al. | 87/35 |
| 4,034,642 | 7/1977 | Iannucci et al. | 87/48 |
| 4,200,126 | 4/1980 | Fish . | |
| 4,304,169 | 12/1981 | Cimprich et al. | 87/29 |
| 4,372,191 | 2/1983 | Iannucci et al. | 87/48 |
| 4,515,737 | 5/1985 | Karino et al. . | |
| 4,887,422 | 12/1989 | Klees et al. | 57/220 |
| 5,048,441 | 9/1991 | Quigley . | |
| 5,203,249 | 4/1993 | Adams et al. | 87/34 |
| 5,556,677 | 9/1996 | Quigley et al. . | |
| 5,580,627 | 12/1996 | Goodwin et al. | 87/34 |
| 5,758,562 | 6/1998 | Thompson | 87/33 |

FOREIGN PATENT DOCUMENTS

| | | | |
|---|---|---|---|
| 0 113 196 | 7/1984 | European Pat. Off. . | |
| 61-52260 | 11/1986 | Japan | 87/34 |

*Primary Examiner*—John J. Calvert
*Assistant Examiner*—Tejash D Patel
*Attorney, Agent, or Firm*—Lahive & Cockfield LLP

[57] ABSTRACT

A helical braider for constructing a triaxially braided tubular member in which the angle formed by primary fiber relative to the longitudinal axis of the tubular member can be controlled independently of the corresponding angles formed by the remaining fibers. The helical braider includes a winder that applies a primary fiber at a selected winding rate and a braider that applies two helical fibers at a selected spin rate. The winder can include a winder motor and a winding station rotatable around the mandrel, while the braider can include a braider motor and a braiding station independently rotatable around the mandrel.

10 Claims, 2 Drawing Sheets

HELICAL BRAIDER

GOVERNMENT RIGHTS

The U.S. Government has rights in this invention pursuant to United States Air Force Contract Number F29601-93-C-0198

BACKGROUND

This invention relates generally to the field of machinery for applying fibers to a shaft and more particularly to a machine for application of triaxially braided fibers to a shaft.

Both recreational and industrial activities employ tubular shaped shafts formed of fibers embedded in a matrix. Hockey sticks, lacrosse sticks, golf clubs, and ski poles can all be formed of tubular shafts formed of fibers embedded in matrix. Variations in the mechanical properties of the shaft can be achieved by varying the manner in which the fibers are woven together as a function of their location on the shaft, such as varying the fiber angle along the length of the shaft. Spoolable tubing utilized in industrial activities, such as oil well operations, can also be formed of fibers embedded in a matrix. Such spoolable tubing can be unspooled into an oil well and then spooled onto a reel for transportation to another oil well. Spoolable tubing extends down into the depths of the well for delivering liquids and for working over the interior surface of the well.

One method for manufacturing tubular shafts containing reinforcing fibers employs a technique wherein a mandrel is passed through a braider that applies fibers around the mandrel. For instance, Shobert, U.S. Pat. No. 3,007,497, discloses a reinforced plastic rod formed by passing a mandrel through a braiding machine which applies an axially oriented fiber along the longitudinal axis of the mandrel. The braiding machine also applies two helically oriented fibers around the mandrel. The angles traced by the two helically oriented fibers are determined by the interaction between the rotation of the braiding machine relative to the mandrel and the translational velocity of the mandrel as it passes through the braiding machine.

Other methods known in the art for manufacturing tubular shafts having reinforcing fibers employ a technique wherein a mandrel passes through various stations that apply fibers around the mandrel. For example, the mandrel is passed through a winding machine that applies an axial fiber and is then passed through a spinning braiding station that applies two helically oriented fibers. If desired, the axially oriented fiber applied by the winding machine can also be made to follow a helical path by rotating the mandrel relative to the winding machine as it passes through the winding machine. This process can be repeated to form additional layers, referred to in the industry as "plies", by passing the mandrel through additional pairs of winding machines and braiding stations.

It is apparent in the foregoing technique that the angle of the helix along which the axial, or primary, fibers are lain cannot readily be controlled independently of the angle of the helices along which the two helically oriented fibers are lain. This is because when the mandrel is rotated to adjust the spin rate of the braiding station, the winding rate of the winding station is changed, and vice versa.

As indicated above, in some applications, it is desirable to vary the mechanical properties of the shaft along its length by varying the angle of the primary fibers and the helically oriented fibers along the shaft's length. This requires the continuous adjustment of the braiding station's spin rate and the mandrel's rotation rate as the mandrel translates along its longitudinal axis. As a practical matter, continuous adjustment of this nature is difficult to achieve accurately enough for precise placement of the three fibers because of transients associated with any complex mechanical system.

A further disadvantage of some prior art techniques is manifested when more than one ply having cross-braided fibers is to be applied and where the primary fibers on each ply are to follow different helical paths. Since the mandrel is a rigid body, it is not possible to simultaneously rotate it at one rate to form the helical path in one ply and to rotate it at a different rate to form the helical path in another ply.

In some applications, it may be impractical to rotate the mandrel at all. For example, the mandrel could be too long to rotate easily or the mandrel may be extruded continuously through a die.

An object of the invention to provide an apparatus for applying a triaxial braid in which the pitch of the priority fiber can be controlled independently of the pitch of the helically oriented fibers.

SUMMARY OF THE INVENTION

A helical braiding machine according to the invention forms a braided tubular member by wrapping fibers around a mandrel extending along a longitudinal axis. The helical braiding machine includes a winder that applies a primary fiber at a selectable winding rate such that the applied primary fiber is oriented at a winding angle relative to the longitudinal axis of the tubular member. The helical braiding machine also includes a braider that applies a clockwise helically-oriented fiber and a counter-clockwise helically-oriented fiber at a selectable spin rate. The braider causes the clockwise and counter-clockwise fibers to rotate relative to the rotational frame of the winder.

The helical braiding machine selectively varies the winding angle of the primary fiber by controlling the winding rate at which the primary fiber is applied to a mandrel translating through the helical braiding machine. The helical braiding machine also selectively varies a braiding angle of the clockwise and counter-clockwise fibers by controlling the spin rate at which the clockwise and counter-clockwise fibers are applied to a mandrel translating through the helical braiding machine.

The winder and the braider apply the fibers without the need to rotate the mandrel. Accordingly, tubular members in thousand foot increments can be manufactured without the joints or other connectors typically required to form long lengths of fiber reinforced tubing. These long lengths of continuous fiber reinforced tubing find application in coiled tubing, line pipe, and subsea lines.

In one aspect of the invention, the braider can include a braiding station and a braider rotator. The braiding station is rotatable about the longitudinal axis and is adapted to permit translation of the mandrel there through. The braiding station applies a clockwise helically-oriented fiber at a first braiding angle and a counter-clockwise helically-oriented fiber at a second braiding angle. The braider rotator spins the braiding station at the selected spin rate such that the braiding station rotates relative to the winder.

The winder can include a winding station and a winding rotator. The winding station is rotatable about the longitudinal axis and is adapted to permit translation of the mandrel there through. The winding station applies a primary fiber at a winding angle relative to the longitudinal axis. The winding rotator drives the winding station around the mandrel at a selected winding rate such that the primary fibers are applied at the winding angle.

As the mandrel translates through the winding station, the primary fibers carried by the bobbins of the winding station are lain along a helical path on the mandrel, thereby forming a winding angle relative to the longitudinal axis. This winding angle can be adjusted by controlling the rate at which the winding station's bobbins are made to rotate about the mandrel and the translation rate of the mandrel through the winding station. In one aspect of the invention, a winder controller, operably coupled with the winding rotator, adjusts the winding angle by controlling the winding rate of the winding rotator.

Similarly, as the mandrel translates through the braiding station, the two helical fibers are lain along two separate helical paths on the mandrel, thereby forming two braiding angles relative to the primary fiber. These braiding angles can be adjusted by controlling the rate at which the braiding station's bobbins move around the mandrel. One aspect of the invention provides for a braiding controller that adjusts the braiding angle by controlling the spin rate of the braiding rotator.

The winding rotator operates such that the rate at which the braiding station bobbins rotate about the mandrel can be controlled independently of the rate at which the winding station bobbins rotate about the mandrel. In this way, the winding angle and the braiding angle can be selectively controlled.

Additionally, the rotation rates of both the winding station bobbins and the braiding station bobbins can be made to vary with time. This provides for a helical braider, according to the invention, that can vary the two braiding angles and the winding angle as a function of position along the mandrel.

These and other features, aspects, and advantages of the invention will be better understood with reference to the following description and the accompanying drawings.

DESCRIPTION OF THE ILLUSTRATED EMBODIMENT

Figure 1A:
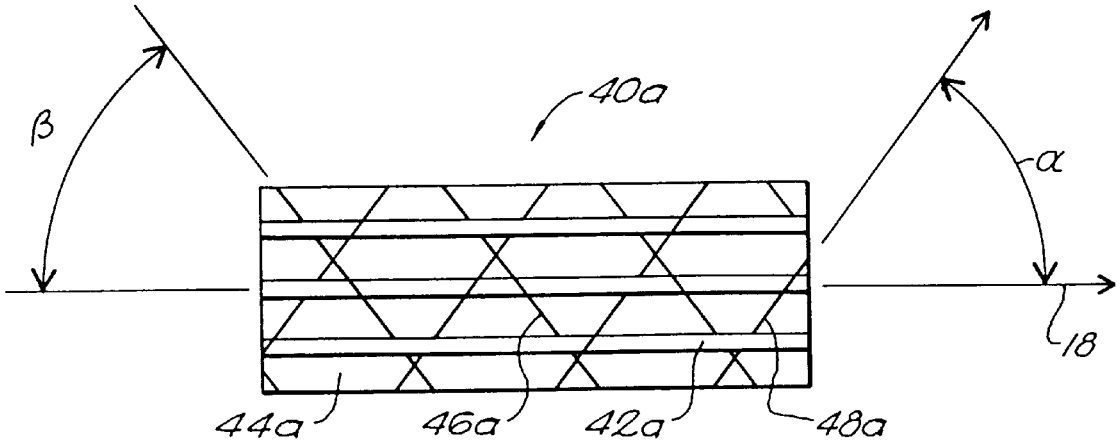
FIG. 1A shows a triaxially braided tube in which the primary fibers are oriented along the mandrel's longitudinal axis.

FIG. 1A shows a flattened out view of a tri-axially braided tubular member 40*a* formed by a helical braider 10 according to the invention. The tubular member 40*a* includes a primary fiber 42*a* directed primarily along a longitudinal axis 18 of a shaft 44*a*, a first helically oriented fiber 46*a* wound clockwise around the shaft 44*a* and forming a braiding angle β relative to the longitudinal axis 18, and a second helically oriented fiber 48*a* wound counter-clockwise around the shaft 44*a* and forming a braiding angle α relative to the longitudinal axis 18. The primary fiber shown is not rotated relative to the longitudinal axis 18, and consequently the braiding angle α equals the braiding angle β.

Figure 1B:
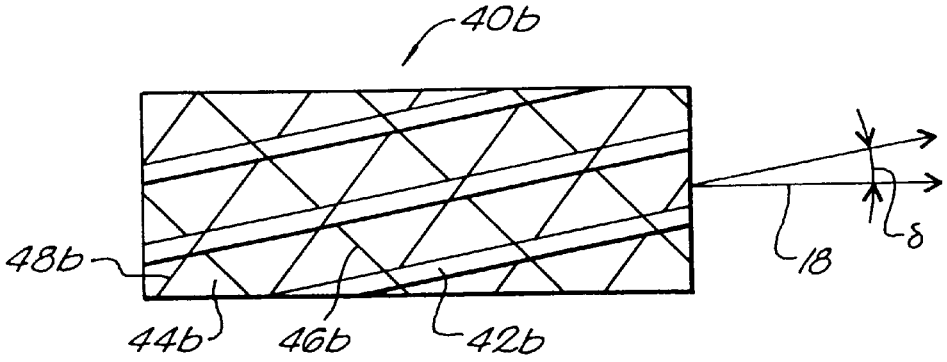
FIG. 1B shows a triaxially braided fiber, similar to that shown in FIG. 1A, in which the primary fibers are helically wound around the mandrel.

The triaxially braided fibers 40*a* shown in FIG. 1A can be modified as shown in FIG. 1B by placing the primary fiber 42*b* along a helical path such that it forms a winding angle γ relative to the longitudinal axis 18 of the shaft 44*b*. It is apparent, therefore, that the triaxially braided fibers 40*a* shown in FIG. 1A are simply the limiting case of the triaxially braided fibers 40*b* shown in FIG. 1B wherein the winding angle γ is set to zero.

Figure 2:
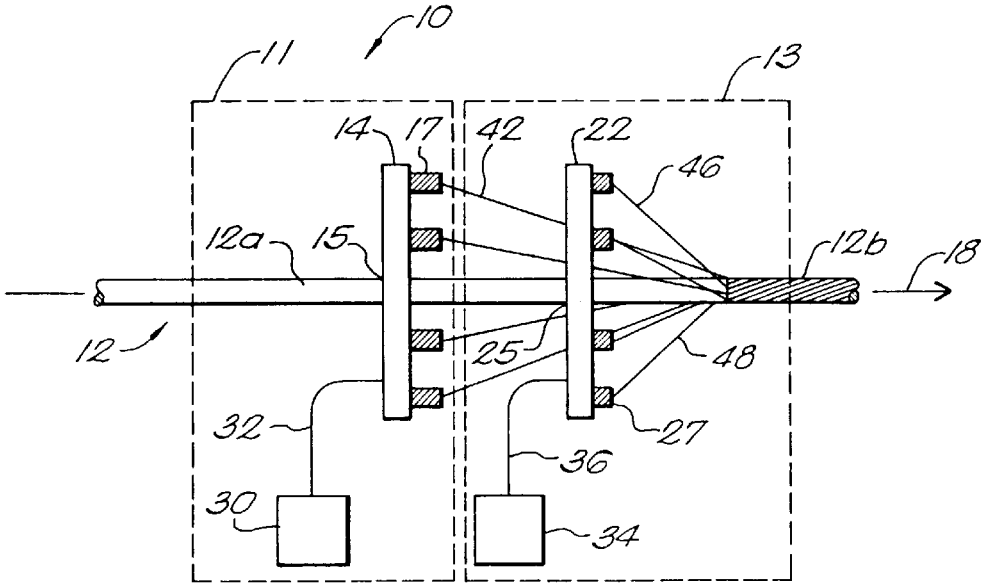
FIG. 2 is a schematic diagram of an apparatus for applying the triaxially braided fibers shown in FIGS. 1A and 1B.

FIG. 2 illustrates the helical braider 10 embodying the invention. The helical braider 10 is adapted to reproduce the triaxially braided fibers 40*a*, 40*b* depicted in FIGS. 1A and 1B. The helical braider 10 includes a winder 11 and a braider 13. The winder 11 applies a primary fiber along the longitudinal axis at a winding angle, whereas the braider 13 applies two helical fibers oriented at a braiding angle. The winder 11 and braider 13 are structured so that the winder applies a primary fiber at a winding angle that is created independently of the braiding angle of the clockwise and counter-clockwise helical fibers.

The winder 11 can include a winder rotator 30 and a rotatably mounted winding station 14 having a central aperture 15 transverse to the longitudinal axis 18 and sufficiently large to pass a mandrel 12 therethrough. A plurality of winding station bobbins 17 mounted to the winding station 14 holds the primary fibers 42 to be applied to the mandrel 12. The winding station 14 is operatively coupled, by a first system of belts and pulleys 32, to the winder rotator 30. The winder rotator 30 causes the bobbin stations 17 to rotate around the mandrel.

The braider 13 can include a braider rotator 34 and a braiding station 22 also having a central aperture 25 transverse to the longitudinal axis 18 and sufficiently large to pass a mandrel 12 therethrough. A plurality of braiding station bobbins 27 holding the clockwise and counter-clockwise helical fibers 46,48 is mounted to the braiding station 22 on a raceway (not shown) in the conventional fashion. The braiding station 22 is operatively coupled to the braider rotator 34. The braider rotator 34 causes the bobbins 27 to rotate around the mandrel.

As the mandrel 12 translates along the longitudinal axis 18, the unwound section 12*a* of the mandrel passes through the winding station 14 which applies the primary fiber 42. Because the winding rotator 30 rotates the winding station 14, the winding station bobbins 17 revolve around the mandrel 12 and apply the primary fiber 42 along a helical path as shown in FIG. 1B. If the winding rotator is turned off, the winding station bobbins 17 are stationary relative to the translating mandrel 12 and the primary fibers 42 are applied parallel to the longitudinal axis 18 as shown in FIG. 1A. The pitch of the helical path, represented by winding γ in FIG. 1B, will depend on the translational velocity of the mandrel 12 and on the rate at which the bobbins 17 mounted on the winding station 14 revolve around the mandrel 12.

The mandrel 12 continues to translate along the longitudinal axis 18 to the braiding station 22 which applies the clockwise and counter-clockwise helical fibers 46, 48 in a conventional manner to the translating mandrel 12. The pitch of the helical path along which the helical fibers 46, 48 are lain, represented by braiding angles α and β in FIG. 1A, is controlled by the translation rate of the mandrel 12 and by the rate at which the braiding station bobbins 27 revolve around the mandrel 12.

In order to control the winding angle γ of the primary fiber 42 independently of the braiding angles, α and β, of the two helical fibers 46, 48, it is necessary to control the rate at which the braiding station bobbins 27 revolve around the mandrel 12 relative to the rate at which the winder bobbins 17 revolve around the mandrel 12. This can be achieved by independently driving the braiding station bobbins 27 and the winder bobbins 17. For instance, the winder bobbins and the braiding station bobbins can be driven by independent variable speed motors. Alternatively, the winder station bobbins can be driven by a variable speed motor and the braiding station bobbins can be mechanically coupled with the winder. The mechanical coupling between the winder and the braider can include a gearing system that allows the rotational motion of the winder to be transferred to the braider. This gearing system between the winder and the braider can also be used to transfer different speed of rotation from the winder to the braider, thereby causing the winder bobbins 17 and the braider bobbins 27 to rotate around the mandrel at different speeds.

Figure 3:
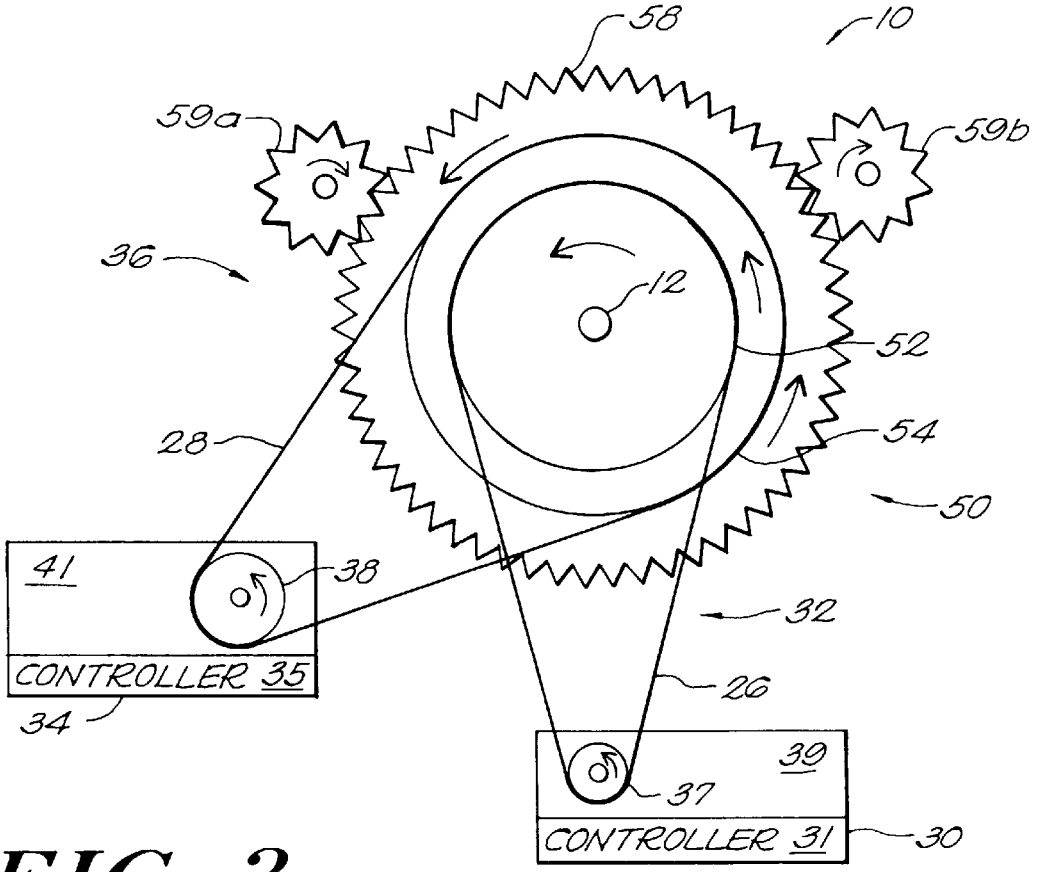
FIG. 3 is a cut-away view of a transverse cut of the apparatus shown in FIG. 2.

FIG. 3 shows a helical braider 10 wherein the braiding station 22 is concentrically positioned around winding station 14. This design requires less space along the length of the mandrel than the aspect of the invention illustrated in FIG. 2. A system of belts and pulleys 32 operatively couple the winding station 14 to the winder rotator 30. The winder rotator can be formed of a variable speed motor 39 that is coupled with the winding station 14. For instance, the rotator can include a winder drive belt 26 looped around a winder motor pulley 37, extending from the variable speed motor 39, and looped around a winder pulley 52. The winder pulley 52 is mounted to drive the rotatably mounted winding station 14.

FIG. 3 also illustrates a system which operatively couples the braiding station 22 with the braider rotator 34. The braider rotator can be formed of a variable speed motor 41 that is coupled with the braiding station 22 by a system of belts and pulleys. For example, the braider rotator can include a braider drive belt 28 looped around a braider motor pulley 38, extending from the motor 41, and looped around a braider pulley 54. The braider pulley 54 is mounted to a braider gear 58 which engages two pinions 59*a*, 59*b* diametrically opposed to each other.

In operation, the winder rotator 30 rotates the winder motor pulley 37 which engages the winder drive belt 26, thereby transmitting the rotary motion of the winder motor pulley 37 to the winder pulley 52. This rotates the winding station 14 mounted to the winder pulley 52, thereby causing the winder bobbins 17 to revolve around the mandrel 12. Similarly, the braider rotator 34 rotates the braider motor pulley 38 which engages the braider drive belt 28, thereby transmitting the rotary motion of the braider motor pulley 38 to the braider pulley 54. As the braider pulley 54 rotates, it causes the braider gear 58 to turn the two pinions 59*a*, 59*b*. The two pinions are coupled, in a conventional fashion, to the braiding station 22 so as to propel the braiding station bobbins 27 along the raceway (not shown).

Other features of the invention provide for a mechanical coupling between the winder 11 and the braider 13. The mechanical coupling causes the braiding station 22 and the winding station 14 to rotate together when the winding station 14 is driven at a selected winding rate. For example, the winding pulley 52 can be mechanically coupled with the braider pulley 54 as shown in FIG. 3 so that the winding pulley 52 and the braider pulley 54 rotate together in the same rotational frame. In a preferred embodiment of the invention, the mechanical coupling between the winder 11 and the braider 13 also allows the braider pulley to rotate at rates exceeding the winding rate. Particularly, as shown in FIG. 3, the braiding station 22 can include a braider pulley driven by a braider rotator 34. In operation, the winder rotator 30 drives the winder pulley 52 and the braiding station 22 at the winding rate, and the braider rotator 34 drives the braider gear 58 and the pinions 59*a*, 59*b* at the spin rate relative to the rotation of the winder station 14.

Another aspect of the invention provides for a winder controller 31 and a braider controller 35. The winder controller 31 controls the winding rate of the winding station, and the braider controller 35 controls the spin rate of the braiding station. Both the winder controller and the braider controller can be formed from electronic hardware of a data processor executing a set of software instructions. The winder controller 31 is operably coupled with the motor 39 to adjust the speed of the winder motor pulley 37, thereby controlling the winding rate. The braider controller 35 is operably coupled with the motor 41 to adjust the speed of the braider motor pulley 38, thereby controlling the spin rate.

It is apparent, therefore, that in the apparatus described above, the rotation rate of the braiding station bobbins 27 can be controlled independently of the rotation rate of the winding station bobbins 17, thereby permitting the selective control of the winding angle $\gamma$ and the selective control of the equal and opposite braiding angles, $\alpha$ and $\beta$.

It will thus be seen that the invention efficiently attains the objects set forth above. Since certain changes may be made in the above construction without departing from the scope of the invention, it is intended that all matter contained in the above description or shown in the accompanying drawings be interpreted in an illustrative and not in a limiting sense.

Having described the invention, what is claimed as new and secured by Letters Patent is:

1. A helical braider for forming a braided tubular member by wrapping fibers around a mandrel extending along a longitudinal axis, said helical braider comprising:

a winding station rotatable about the longitudinal axis for applying a primary fiber to the mandrel, a winder rotator operatively coupled to said winding station for rotating said winding station at a selectable winding rate such that said primary fiber is oriented at a winding angle relative to said longitudinal axis, a braiding station rotatable about the longitudinal axis for applying a clockwise helically-oriented fiber and a counter-clockwise helically-oriented fiber about the mandrel, and a braider rotator operatively coupled to said braiding station for spinning said braiding station at a selected spin rate such that said clockwise and counter-clockwise fibers can rotate relative to the rotational frame of said winder.

2. The helical braider of claim 1, wherein said braider rotator comprises a variable speed motor operably coupled with said braiding station by a drive belt and a pulley.

3. The helical braider of claim 2, further comprising a braider controller operably coupled with said motor for controlling the spin rate, the spin rate being determined as a function of the winding rate.

4. The helical braider of claim 1, wherein said braiding station comprises a braider pulley centered at the longitudinal axis and first and second pinions coupled with said braider pulley, said first pinion propelling a first bobbin around the longitudinal axis in a clockwise direction and said second pinion propelling a second bobbin around the longitudinal axis in a counter-clockwise direction.

5. The helical braider of claim 1, wherein said winder rotator comprises a variable speed motor operably coupled with said winding station by a drive belt and a pulley.

6. The helical braider of claim 5, further comprising a winder controller for controlling the selectable winding rate.

7. The helical braider of claim 1, wherein said winding station comprises a winder pulley centered at the longitudinal axis for propelling a bobbin holding said primary fiber around the longitudinal axis.

8. A helical braider for forming a braided tubular member by wrapping fibers around a mandrel extending along a longitudinal axis, said helical braider comprising:

a winding station rotatable about the longitudinal axis for applying a primary fiber to said mandrel, a winder rotator operatively coupled to said winding station for rotating said winding station at a selectable winding rate such that said primary fiber is oriented at a winding angle relative to said longitudinal axis, a braiding station rotatable about the longitudinal axis for applying a clockwise helically-oriented fiber and a counter-clockwise helically-oriented fiber about the mandrel, said braiding station being operably coupled with said winding station such that said braiding station and said winding station rotate together, and a braider rotator operatively coupled to said braiding station for spinning said braiding station at a selected spin rate such that said clockwise and counter-clockwise fibers can rotate relative to the rotational frame of said winder.

9. The helical braider according to claim 8, wherein said braiding station is concentrically positioned relative to said winding station.

10. A helical braider for forming a braided tubular member by wrapping fibers around a mandrel extending along a longitudinal axis, said helical braider comprising:

winding means rotatable about the longitudinal axis for applying a primary fiber to said mandrel, winder rotating means operatively coupled to said winding means for rotating said winding means at a selectable winding rate such that said primary fiber is oriented at a winding angle relative to said longitudinal axis, braiding means rotatable about the longitudinal axis for applying a clockwise helically-oriented fiber and a counter-clockwise helically-oriented fiber about the mandrel, said braiding means being operably coupled with said winding means such that said braiding means and said winding means rotate together, and braider rotating means operatively coupled to said braiding means for spinning said braiding means at a selected spin rate such that said clockwise and counter-clockwise fibers can rotate relative to the rotational frame of said winding means.

* * * * *